US009466931B1

(12) United States Patent
King

(10) Patent No.: US 9,466,931 B1
(45) Date of Patent: Oct. 11, 2016

(54) DEVICE FOR USE WITH AN ELECTRONIC APPARATUS

(71) Applicant: Christopher David Challis King, Watford (GB)

(72) Inventor: Christopher David Challis King, Watford (GB)

( * ) Notice: Subject to any disclaimer, the term of this patent is extended or adjusted under 35 U.S.C. 154(b) by 0 days.

(21) Appl. No.: 14/852,277

(22) Filed: Sep. 11, 2015

(51) Int. Cl.

| | |
|---|---|
| ***H01R 13/58*** | (2006.01) |
| ***H01R 24/60*** | (2011.01) |
| ***H01R 13/73*** | (2006.01) |
| *H01R 107/00* | (2006.01) |

(52) U.S. Cl.
CPC ..... *H01R 24/60* (2013.01); *H01R 13/73* (2013.01); *H01R 2107/00* (2013.01)

(58) Field of Classification Search
CPC ... H01R 13/562; H01R 13/565; H01R 13/58
USPC ..... 439/474, 475
See application file for complete search history.

(56) References Cited

U.S. PATENT DOCUMENTS

| | | | | |
|---|---|---|---|---|
| 6,834,810 | B2 * | 12/2004 | Maruyama | G06K 13/08 235/375 |
| 2004/0215966 | A1 * | 10/2004 | Elteto | H01R 35/02 713/182 |
| 2009/0181572 | A1 * | 7/2009 | Tracy | H05K 5/0278 439/447 |
| 2009/0323297 | A1 | 12/2009 | Huang | |

* cited by examiner

*Primary Examiner* — Phuong Dinh
(74) *Attorney, Agent, or Firm* — Andrew W. Chu; Craft Chu PLLC

(57) ABSTRACT

A device for connection into a socket on an electronic apparatus includes a plug portion inserted into the socket, a substantially rigid body, and a cover connecting the plug portion to the body. The cover includes a flexible joint, and the plug portion is electrically connected to the body through the joint. The plug portion protrudes from an edge of the cover, and the joint can flex about an axis spaced by a fixed distance of less than 15 mm from the edge of the cover from which the plug portion protrudes and parallel thereto.

15 Claims, 7 Drawing Sheets

SECTION A-A (Fig 2)

SECTION A-A (Fig 2)

SECTION B-B (Fig 1)

DEVICE FOR USE WITH AN ELECTRONIC APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present disclosure relates to small electrical devices for connection to larger electrical apparatus such as computers. In particular, the present invention relates to devices for insertion into USB (Universal Serial Bus) or HDMI (High-Definition Multimedia Interface) sockets on laptop computers or any other electrical device.

2. Description of Related Art Including Information Disclosed Under 37 CFR 1.97 and 37 CFR 1.98.

Such devices are well known in the art. They include USB or HDMI cables, USB mass storage devices, radio modems and software dongles. Such devices comprise a plug portion and a main body portion housing electrical/electronic components.

When such a device is plugged into a computer or other electronic apparatus it protrudes from the electronic apparatus. There is therefore a risk of knocking the device in such a way that a sheer force may be applied to the electrical socket, causing the device's plug to snap off in the socket. This would cause damage to both the socket and device. Even if the plug does not break off in the socket, the shearing force applied to the plug when the device is knocked can damage the socket and/or the device. This could occur, for example, on dropping a laptop computer.

It is therefore an object to provide a means for reducing the chance of causing damage to a socket when a device plugged into that socket is knocked.

SUMMARY OF THE INVENTION

According to a first aspect there is provided a device for connection into a socket on an electronic apparatus, the device comprising:

a plug portion adapted to be inserted into the socket, a substantially rigid body, and a cover connecting the plug portion to the body, wherein the cover includes a flexible joint, and wherein the plug portion is electrically connected to the body through the joint, wherein the plug portion protrudes from an edge of the cover, and wherein the joint can flex about an axis positioned a fixed distance of less than 15 mm from the edge of the cover from which the plug portion protrudes.

The rigid body houses electrical/electronic components of the device.

The flexible joint enables the substantially rigid body of the device to move about an axis. The flexible joint may be arranged such that there is a single predetermined axis about which the rigid body of the device can move.

When the device is plugged into a socket on an electronic apparatus and the device is hit so that a force is applied to the body, the body will be able to move about the axis in response to the force. This reduces the shearing force applied to the socket, reducing the chance of damaging the socket, and hence reducing the chance of breaking the plug portion off from the rest of the device.

Preferably, the cover is molded in one piece. Molding the cover in a single piece is advantageous as it enables the joint to be positioned close to the edge of the cover from which the plug portion protrudes. Preferably, the joint is formed by an area of reduced thickness in the cover.

The cover may also comprise a shoulder portion at the edge of the cover from which the plug protrudes.

The cover may partially or completely surround and encapsulate the rigid body. The rigid body and the cover surrounding it form a main body of the device.

Preferably, the thickness of the main body is greater than the distance between the axis of the joint and the edge of the cover. If the thickness of the main body of the device is greater than the distance of the joint from the edge of the cover, it will disperse impact energy into the body of the electrical equipment rather than into the socket. Most preferably, the thickness of the main body is about twice the distance of the joint from the edge of the cover.

The joint is preferably made of elastomeric material. More preferably, the cover is made of elastomeric material. All parts of the cover may be made of a single elastomeric material, or different parts may be made of different elastomers molded together. For example, the joint may be made of a different elastomer to the part of the cover from which the plug portion protrudes. The elastomeric material(s) should preferably be rigid enough to enable the plug portion, joint and main body to all lie substantially along the same axis when no force is applied (the rest position). The elastomeric material should also be rigid enough to maintain the rest position if a very small force (a force that could not possibly cause damage to the socket) is applied to the body. However, the elastomeric material must also be flexible enough to allow the joint to bend when a sufficiently large force is applied to the main body.

Having a joint that has an axis positioned less than 15 mm from the edge of the cover from which the plug portion protrudes is advantageous as this decreases the chance of snapping off the plug portion or damaging the socket. If the axis is positioned less than 15 mm from the edge of the cover, when the plug portion is inserted into a socket of an electronic apparatus, there is only a small distance between the edge of the electronic apparatus and the axis.

This is beneficial as it allows the joint to bend very close to the edge of the electronic apparatus, decreasing the shearing force applied to the socket of the electronic apparatus. It additionally decreases the chance that the force will be exerted directly on the portion of the cover of the device lying between the plug portion and the joint.

Therefore, the smaller the distance between the edge of the cover and the axis about which the joint can flex, the less chance the socket will be damaged in response to an external force. Preferably, the joint can flex about an axis positioned less than 10 mm from the edge of the cover from which the plug portion protrudes. More preferably, the joint can flex about an axis positioned about 5 mm from the edge of the cover from which the plug portion protrudes.

The joint may be adapted to flex through at least 45°. Preferably, the joint is adapted to flex through at least 90°.

The joint may be a universal joint. A universal joint is advantageous as it allows the body to flex in all directions relative to the cover. A universal joint may be provided simply by the flexibility of the material of the joint. With a universal joint a number of axes will be provided, all of which are a fixed distance from the edge of the cover from which the plug portion protrudes.

The plug portion may be a USB plug. A USB plug is a rectangular metal connector containing pins for making electrical connection in the socket of an electrical device such as a computer. The USB plug may be any type of USB plug, for example, a standard type A, a standard type B, a mini-A, a mini-B, a micro-A or a micro-B. All these types of USB plug comprise metal pins that are adapted to interact with connections provided in a corresponding USB socket.

Alternatively, the plug portion may be a HDMI plug, or any other plug that can be fitted into an electronic apparatus.

The substantially rigid body may be a USB socket. A USB socket comprises a metal box into which a USB plug can be inserted so that an electrical connection is formed between pins of the USB plug and the socket. Like USB plugs, USB sockets can be many different types, for example, type A, type B, mini-A, mini-B, micro-A or micro-B. A device according to the present invention may comprise a USB plug of one type, and a USB socket of the same or a different type.

Alternatively, the substantially rigid body may comprise a HDMI socket or any other type of socket that enables electronic devices to be connected to electronic apparatus such as laptop computers. It is the components of the socket, for example, the metal box forming part of the HDMI socket, that give the body its rigidity.

The body may alternatively contain a mass storage device, software dongle, or other electrical device. The device may then be a USB flash drive, for example. It is the internal components of the mass storage device, such as the memory storage unit, that give the body its rigidity.

BRIEF DESCRIPTION OF THE DRAWINGS

Preferred arrangements will now be described, by way of example only, by reference to the accompanying drawings.

DETAILED DESCRIPTION OF THE DRAWINGS

Figure 5:
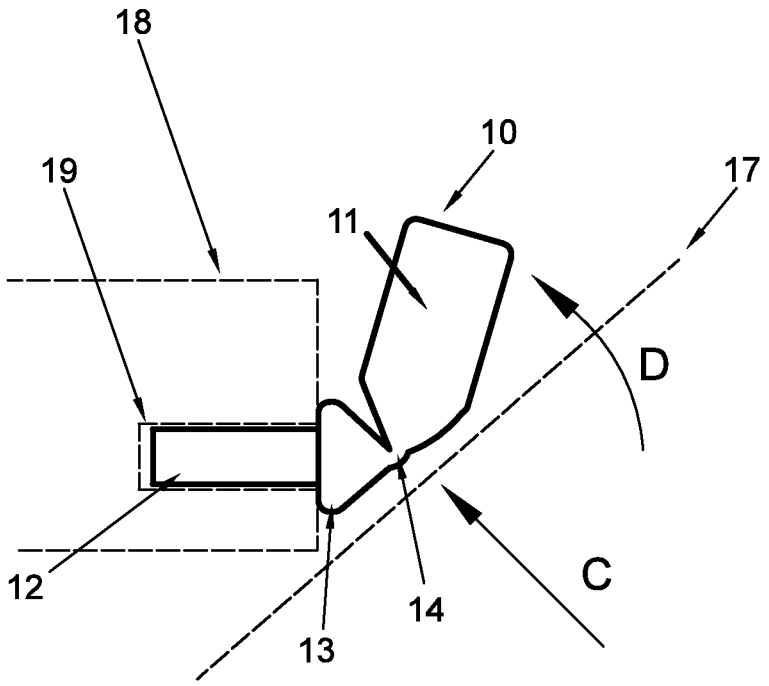
FIG. 5 shows a schematic view of the device of FIG. 1 having flexed after hitting a surface.
Figure 6:
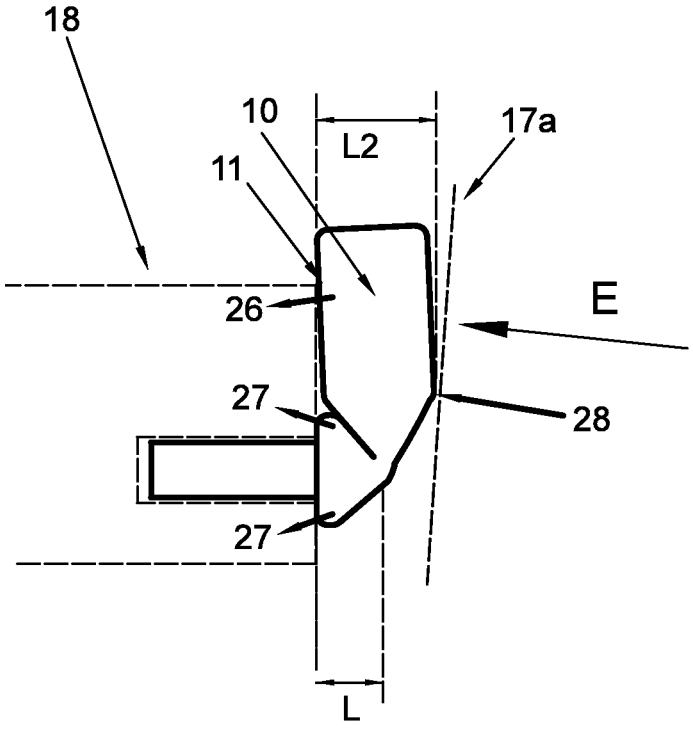
FIG. 6 shows a schematic view of the device of FIG. 1 having flexed through 90° after hitting a surface.
Figure 7:
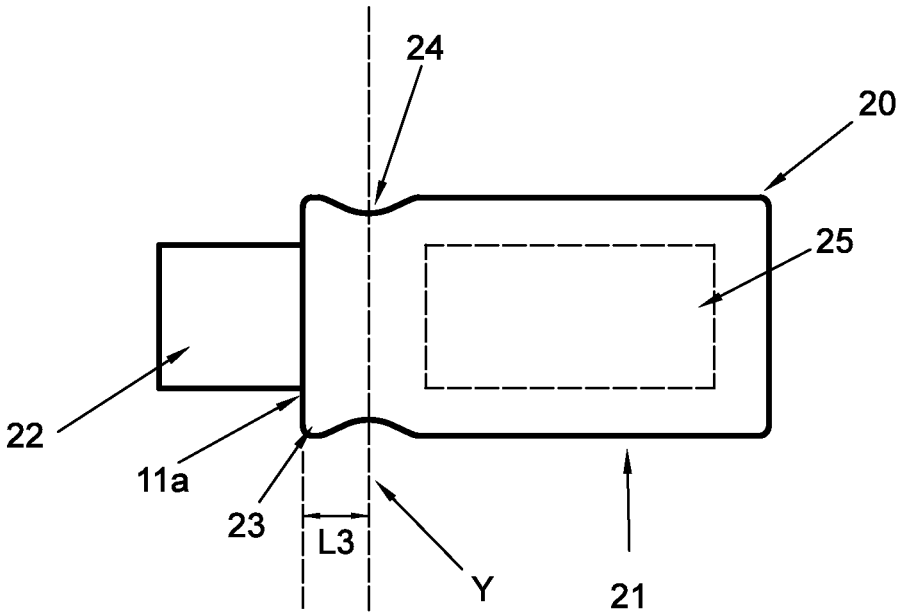
FIG. 7 shows a schematic view of an alternative embodiment of the device.

FIGS. 1 to 7 show two different embodiments of a device. The device shown in FIGS. 1 to 6 is a USB connector, and the device shown in FIG. 7 is a USB mass storage device.

Referring to FIGS. 1 to 6, there is a USB connector 10 for connection into a socket on an electronic apparatus. The USB connector 10 comprises a USB plug portion 12 adapted to be inserted into the socket, a substantially rigid body 15, and a cover 11 connecting the USB plug portion 12 to the body 15. The cover includes a flexible joint 14, and the USB plug portion 12 is electrically connected to the body 15 through the joint 14.

Figure 1:
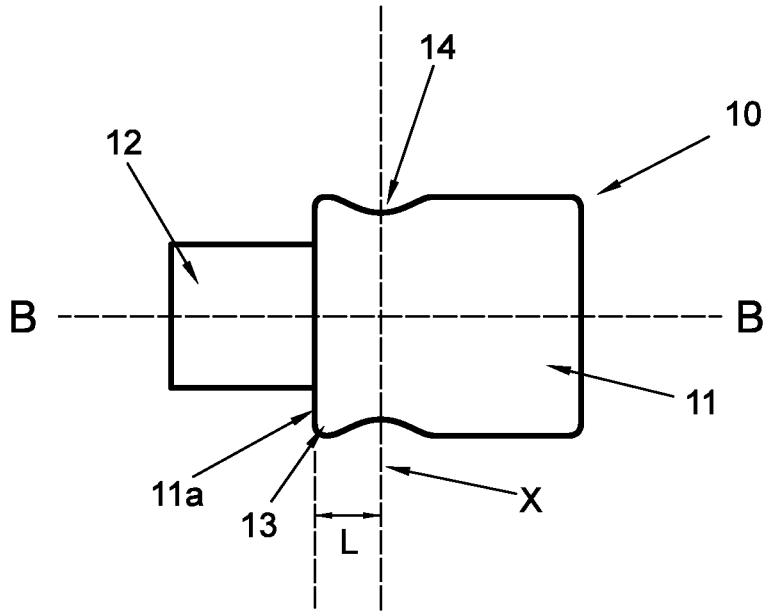
FIG. 1 shows a top schematic view of an embodiment of the device.

The USB plug portion 12 protrudes from an edge 11*a* of the cover 11, which may comprise a substantially planar face. In FIG. 1, the joint 14 can bend about an axis X positioned a fixed distance L from the edge 11*a* of the cover 11 from which the plug portion protrudes and parallel thereto. The distance L is less than 15 mm, preferably less than 10 mm, and most preferably about 5 mm.

The joint 14 is formed by an area of reduced thickness in the cover 11. The joint 14, therefore, forms a neck. The neck is preferably tapered from the direction of the plug towards the joint axis and from the direction of the body towards the joint axis. In this manner opposed upper and lower wedge surfaces are provided either side of the joint axis. Each of the wedge surfaces is preferably arranged at 45 degrees relative to line A-A of FIG. 2.

The area of the cover 11 from which the plug portion 12 protrudes forms a shoulder 13 which defines the edge 11*a*. The shoulder 13 of the cover 11 surrounds an end of the plug portion 12. The joint 14 provides a flexible hinge joint running across the device along the axis X which separates the shoulder 13 from the main body of the device.

The USB plug portion 12 is a rectangular metal connector containing pins for making an electrical connection in the socket of a computer etc.

Figure 2:
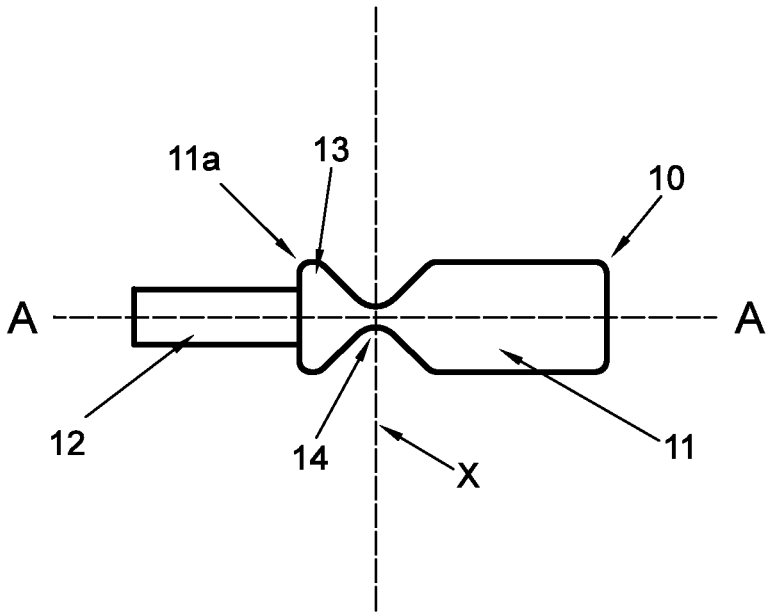
FIG. 2 shows a side schematic view of the device of FIG. 1.
Figure 3:
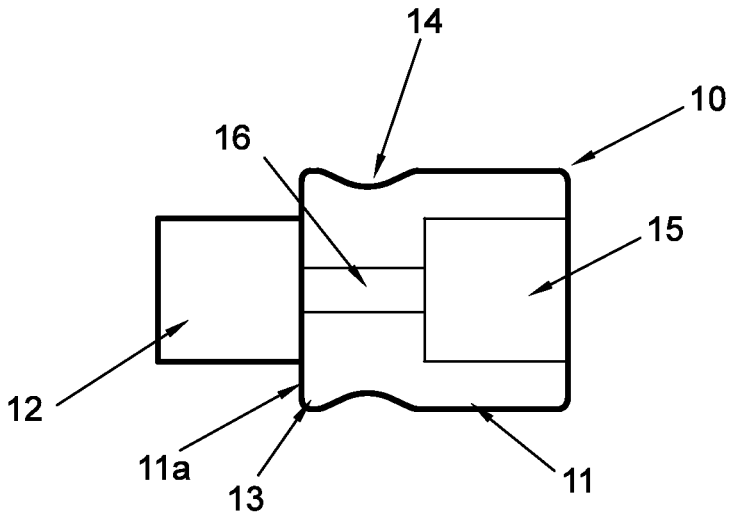
FIG. 3 shows a cross sectional view of the device of FIG. 1 taken along the line A-A of FIG. 2.
Figure 4:
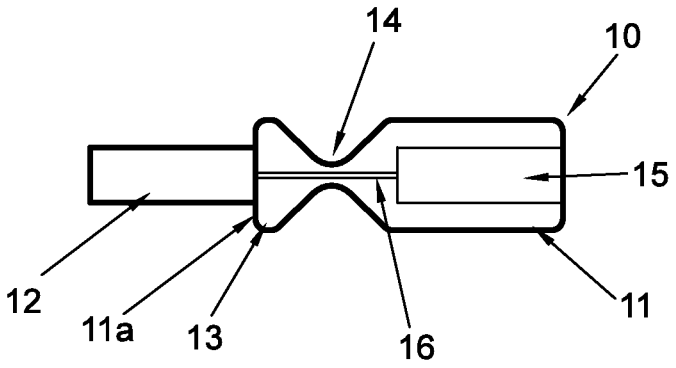
FIG. 4 shows cross sectional view of the device of FIG. 1 taken along the line B-B of FIG. 1.

FIG. 3 shows a cross sectional view of the connector 10 taken along line A-A of FIG. 2. FIG. 4 shows a cross sectional view of the connector 10 taken along line B-B of FIG. 1. In these cross sectional views, the substantially rigid body shown (15) is a USB socket. The USB socket 15 comprises a rigid metal box. It is the rigid metal box of the USB socket that makes the body substantially rigid. FIGS. 3 and 4 show the USB plug 12 connected to the USB socket 15 by an electrical connection 16 which passes through the joint 14. The cover partially encapsulates the rigid body 15 but leaves open access thereto for the insertion of the plug of another device. The rigid body 15 and the cover surrounding it form a main body of the device.

In the embodiment shown in FIGS. 1 to 6, the cover 11 extends over the USB socket 15 (shown in FIGS. 3 and 4) so that one side is exposed. The cover 11 has been made from a single moulding. Preferably, the cover 11 has been moulded from elastomeric material.

FIG. 5 shows the connector 10 in a bent configuration after it has come into contact with surface 17. The USB plug portion 12 of the connector 10 is shown inserted into a USB socket 19 in part of the body of a laptop computer 18.

Surface 17 was moved in direction C towards the connector. When the surface 17 came into contact with the connector 10, the joint 14 bent, enabling the body of the connector 10 to move in direction D thus reducing the sheer force applied to the USB plug portion. The joint 14 has flexed through at least 45°. As the sheer force is reduced, the chance of the USB plug portion 12 being broken off in the socket 19 of the computer 18 is reduced.

FIG. 6 shows the connector 10 in a bent configuration after it has come into contact with surface 17*a*. Surface 17*a* was moved in direction E towards the connector. When surface 17*a* came into contact with the connector 10, the joint 14 bent, enabling the body of the connector 10 to move in direction E.

In FIG. 6, the joint has flexed through slightly more than 90° so that the part of the cover 11 has come into contact with the edge of the computer. Because the thickness of the main body of the device is greater than the distance L, the distance L2 from the edge of the computer to the impact point 28 is also larger than the distance L from the edge of the computer to the flexible joint. As a result, most of the impact energy is transmitted from point 28 straight to the body of the computer at point 26. As the cover 11 is made from an elastometric material, this impact energy will be mostly absorbed, both by the cover 11 and by the case of the computer 18. The amount of energy transmitted to points 27 at the socket surface will be minimal, and not enough to cause damage to the socket. Preferably, the thickness of the main body is about twice the distance L. In the position shown in FIG. 6, the upper surface of the device has, by virtue of the joint (with its tapered surfaces either side of the axis) been brought into a position in which it is substantially co-planar with the front face 11*a*. The faces here are not fully co-planar, since the joint has allowed for a flex through slightly more than 900. With arrangements in accordance with the present disclosure it is preferable that these faces may be brought into close alignment.

Referring to the alternative embodiment shown in FIG. 7, there is a mass storage device 20 comprising a USB plug portion 22 adapted to be inserted into the socket, a substantially rigid body 25, and a cover 21 that connects the USB plug portion 22 to the body 25. The cover includes a flexible joint 24, and the USB plug portion 22 is electrically connected to the body 25 through the joint 24. The USB plug portion 22 protrudes from an edge 21*a* of the cover 21. The joint 24 can bend about an axis Y positioned a distance L3 from the edge 11*a* of the cover 21 from which the plug portion protrudes. The distance L3 is less than 15 mm, preferably less than 10 mm, and most preferably about 5 mm.

In this alternative embodiment, the body 25 is the electronics unit of the mass storage device 20. The cover 21 of the device completely surrounds the body. The cover 21 comprises a shoulder 23 at the end of the cover 21 from which the USB plug portion 22 protrudes. All features of the device of FIGS. 1 to 6 can be applied to the device of FIG. 7 as appropriate.

I claim:

1. A device for connection into a socket on an electronic apparatus, the device comprising:

a plug portion so as to be inserted into the socket;

a substantially rigid body;

a cover connecting said plug portion to the body, wherein said cover comprises a flexible joint, wherein said plug portion is electrically connected to the body through the joint;

wherein plug portion protrudes from an edge of said cover, and wherein the joint flexes about an axis positioned a fixed distance of less than 15 mm from said edge of said cover from which said plug portion protrudes, and wherein said cover is tapered between said plug portion and the joint and between the body and the joint; and a substantially planar front face from which said plug portion protrudes, wherein the body has upper and lower substantially planar surfaces, wherein said cover is tapered and, upon bending in an upwards direction, the upper substantially planar surface of the body is positioned substantially co-planar with a front face, upon bending in an downwards direction, the lower substantially planar surface of the body is positioned substantially co-planar with said front face.

2. The device according to claim 1, wherein the joint flexes about an axis positioned a fixed distance of less than 10 mm from said edge of the cover from which said plug portion protrudes.

3. The device according to claim 1, wherein the joint flexes about an axis positioned a fixed distance of about 5 mm from said edge of said cover from which said plug portion protrudes.

4. The device according to claim 1, wherein the body has a thickness greater than a distance between said axis of the joint and said edge of said cover, wherein impact energy is dispersed into a body of electrical equipment rather than into the socket.

5. The device according to claim 1, wherein a taper angle is 45 degrees or less.

6. The device according to claim 1, wherein the joint flexes through at least 45°.

7. The device according to claim 1, wherein said cover is molded in one piece.

8. The device according to claim 1, wherein the joint is comprised of an area of reduced thickness in said cover.

9. The device according to claim 1, wherein said cover at least partially surrounds said substantially rigid body.

10. The device according to claim 9, wherein said cover and said rigid body form the body, and wherein the thickness of the body is greater than a distance from said edge of said cover to said axis of said flexible joint.

11. The device according to claim 1, wherein said cover is comprised of elastomeric material.

12. The device according to claim 1, wherein the joint flexes in all directions.

13. The device according to claim 1, wherein the plug portion is selected from a group consisting of: a USB, HDMI and other type of electrical plug.

14. The device according to claim 1, wherein the body comprises a USB, HDMI or other type of electrical socket.

15. The device according to claim 1, wherein the body is comprised of at least one of a group consisting of: a mass storage device, software dongle, radio modem and other small electrical device.

* * * * *